US005937581A

United States Patent [19]

Matye et al.

[11] Patent Number: 5,937,581

[45] Date of Patent: Aug. 17, 1999

[54] AUTOMATED HATCH OPENING DEVICE

[75] Inventors: Reinhard Matye; Phillip Dean Skeel, both of Charlevoix, Mich.

[73] Assignee: DCL, Inc., Charlevoix, Mich.

[21] Appl. No.: 09/057,027

[22] Filed: Apr. 8, 1998

[51] Int. Cl.[6] ..... E05F 11/02

[52] U.S. Cl. ..... 49/279; 49/280

[58] Field of Search ..... 49/279, 281, 280, 49/282, 285, 291, 292, 293, 295, 300

[56] References Cited

U.S. PATENT DOCUMENTS

| | | | |
|---|---|---|---|
| 706,829 | 8/1902 | Johnson | 49/279 |
| 2,464,670 | 3/1949 | Carlson | 49/300 |
| 2,551,750 | 5/1951 | Liskey | 49/477.1 X |
| 3,557,497 | 1/1971 | Schafer et al. | 49/280 X |
| 5,001,866 | 3/1991 | Powell et al. | 49/477.1 |

FOREIGN PATENT DOCUMENTS

| | | | |
|---|---|---|---|
| 2334648 | 1/1975 | Germany | 49/280 |

OTHER PUBLICATIONS

One (1) page from KNAPPCO Catalog dated Jan. 1987 illustrating a manhole cover.

*Primary Examiner*—Jerry Redman
*Attorney, Agent, or Firm*—Van Dyke, Gardner, Linn & Burkhart, LLP

[57] ABSTRACT

A hatch opening and closing device for a vehicle includes a cover, which is adapted to cover and seal an opening in a vehicle and to pivot between an open position and a closed position, and at least one locking device, which is adapted to move between an unlocked position and a locked position. The locking devices includes an engagement surface for engaging the cover when the cover is in the closed position thereby locking the cover in the closed position. The cover is releasably coupled to the locking device by a lost motion device over a first range of motion and decoupled from the locking device over a second range of motion so that the locking device can be independently moved from the cover. The hatch opening and closing device further includes a driver, which pivots the locking device and cover between the unlocked position and the locked position and the open position and the closed position, respectively.

29 Claims, 5 Drawing Sheets

VIII A
III
10
12
15
15A
16
17
18
18A
19A
19B
20
22
26
26B
27
34
35
36
42
45
48
50A
50B
52A
54
56
58A
58B
59A
59B
59C
59D
60A
65
67

AUTOMATED HATCH OPENING DEVICE

TECHNICAL FIELD AND BACKGROUND OF THE INVENTION

This invention relates to an opening device and, more particularly, to an automated hatch opening device for a vehicle such as a trailer truck.

Trailer trucks used for transporting dry bulk products, such as ash, cement, lime, plastic resin, fertilizers, chemicals, and the like, typically include one or more storage containers. The bulk product is loaded into the respective containers through one or more hatches provided in the top of the container which must be opened and closed before and after filling. A conventional hatch includes a cover, which is pivotally mounted to the container and secured in a closed position over a fill opening of the container by hold down bolts. The cover typically includes a plurality of tabs or ears which are engaged by the respective hold down bolts to close and seal the cover over the fill opening. In order to open the hatch, each hold down bolt must be loosened and then disengaged from the tab. In a like manner, when the hatch is closed, each hold down bolt must be repositioned to engage a respective tab and tightened down to assure an effective seal between the cover and the container. Most hatches include four or more hold down bolts. It can be appreciated that the process of opening and closing a conventional hatch is time consuming.

Moreover, the driver of the trailer must exit the cab of the truck and scale the side of the truck and walk or crawl along the top of the container to reach the hatch to unlock and open the hatch before filling and then subsequently rescale the side of the truck to close and lock the hatch after the filling process is complete. Since these storage containers are generally rounded, this process may pose the risk of falling or other injuries to the driver. Recently, the danger in falling from the truck has prompted agencies to promulgate regulations which require bulk producers and delivery site owners to provide safety cages or platforms which support the driver while he/she opens an closes the hatch to reduce the risk of injury to the driver. However, these safety cages or platforms are expensive to install and maintain.

Consequently, there is a need for a hatch opening device that will eliminate the associated risks with the conventional method of opening and closing hatches and will save time. Moreover, there is a need for a hatch opening device that will reduce the danger to the driver without the increased cost associated with safety cages.

SUMMARY OF THE INVENTION

Accordingly, the present invention provides a new and unique automated hatch opening device which is specially suited for opening a hatch cover of a fill opening in a vehicle so that bulk material can be loaded into the vehicle through the opening quickly and without the risks associated with manual opening and closing the hatch cover.

In one form of the invention, a hatch opening and closing device for a vehicle includes a cover, at least one locking device, and a driver. The cover is adapted to cover and seal an opening in a vehicle and to pivot between an open position, in which the cover seals the opening, and a closed position. The locking device is adapted to move between an unlocked position and a locked position and further adapted to move from the unlocked position to the locked position when the cover is in the closed position to lock the cover in the closed position. Further, the locking device is adapted to move from the locked position to the unlocked position to unlock the cover and to permit the cover to move from its closed position to its open position. The cover is drivingly coupled to the locking device over a first range of motion for movement therewith and decoupled from the locking device over a second range of motion.

In one aspect, the hatch opening device includes a driver assembly. The driver assembly moves the locking device between its unlocked and locked position and pivots the cover between its open and closed positions. Preferably, the driver assembly releasably couples the cover to the locking device over the first range of motion. In another form, the driver preferably includes a shaft which is coupled to the locking device and which is releasably coupled to the cover. The shaft pivots the cover between the open position and the closed position when the shaft is coupled to the cover and rotates freely from the cover when the cover is uncoupled from the shaft. The shaft also pivots the locking device between the unlocked position and the locked position.

In a further aspect, the shaft or the cover includes a stop, and the other of the shaft and the cover includes a pair of circumferentially disposed abutments. The stop moves between the abutments when the cover is uncoupled from the shaft and engages one of the abutments to couple the cover to the shaft. For example, the abutments may be defined by an elongate recess, and the stop may comprise a pin.

In another aspect, the cover of the hatch opening and closing device includes a flexible seal for sealing the cover over the opening of the vehicle when the cover is in the closed position. Preferably, the flexible seal comprises an inflatable bladder.

In another form of the invention, a hatch opening and closing device includes a shaft, a driver, a cover having a bracket, and at least one locking arm. The shaft includes a collar, which includes a recess defining first and second abutments. The driver is coupled to the shaft and rotates the shaft about a longitudinal axis of the shaft. The shaft is journaled in the bracket, which includes a coupling member which engages one of the abutments to couple the cover to the shaft and disengages from the abutments to decouple the cover from the shaft. The locking arm is preferably pivotally mounted to the vehicle and is drivingly coupled to the shaft, moving between a locked position wherein the locking arm is engaged with the cover and an unlocked position wherein the locking arm is disengaged from the cover.

In one aspect, the hatch opening and closing device includes a second locking arm. The second locking arm is pivotally mounted to the vehicle and drivingly coupled to the shaft. The locking arms move between the locked position when the driver rotates the shaft about the longitudinal axis of the shaft wherein each of the locking arms is engaged with the cover and an unlocked position wherein the locking arms are disengaged from the cover.

In another aspect, the cover includes a pair of spaced, downwardly projecting flanges, with the inner one of the flanges extending into the opening of the vehicle. Furthermore, the cover may include a flexible seal for positioning between the inner flange and the opening of the vehicle to seal the opening. Preferably, the flexible seal comprises an inflatable bladder.

As will be understood from the foregoing, the hatch opening and closing device of the present invention provides numerous advantages over the prior known devices. The hatch opening and closing device eliminates the risks associated with the driver of the vehicle exiting the vehicle and climbing on top of the vehicles' storage container to manually open or close the hatch cover. Furthermore, the hatch opening and closing device eliminates the iterative steps presently required to unlock and lock conventional hatch covers. The hatch opening and closing device is an automated device which permits the driver of the vehicle to actuate the hatch opening and closing device from the cab of the vehicle. The device also includes a lost motion mechanism enabling one operating mechanism to operate both a locking device and the movable cover in successive actions. These and other objects, advantages, purposes and features of the invention will become more apparent from the study of the following description taken in conjunction with the drawings.

DESCRIPTION OF THE PREFERRED EMBODIMENTS

Figure 1:
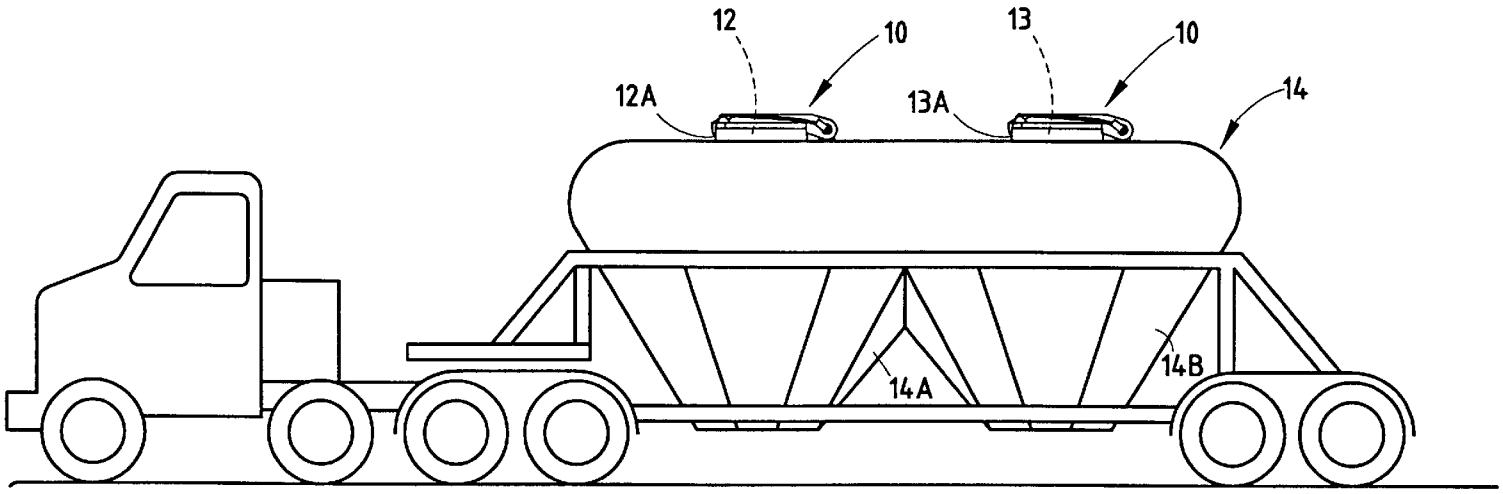
FIG. 1 is a trailer truck with a hatch opening device according to the present invention.
Figure 3:
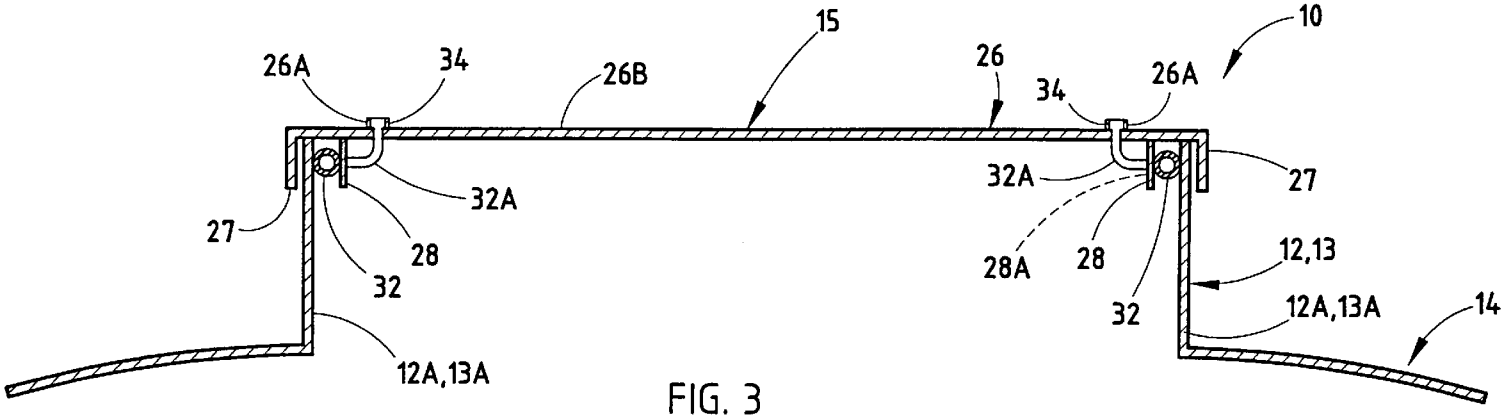
FIG. 3 is a cross-sectional view taken along line III—III of FIG. 2.

Referring to FIGS. 1–7, the numeral 10 generally designates an automated hatch opening device according to the present invention which is suitable for covering and sealing fill openings 12 and 13 of a bulk transportation vehicle 14, such as a trailer truck. In the illustrated embodiment, vehicle 14 includes a pair of automated hatch opening devices 10 which are respectively associated with openings 12 and 13 of vehicle 14. However, to simplify the description, reference hereinafter will be made to the automated hatch opening device 10 which is positioned over opening 12 of the vehicle. Further, it should be understood that automated hatch opening device 10 may be used on a vehicle having a single opening or more than two openings.

Figures 2, 8A, 8B, 8C, 8D:
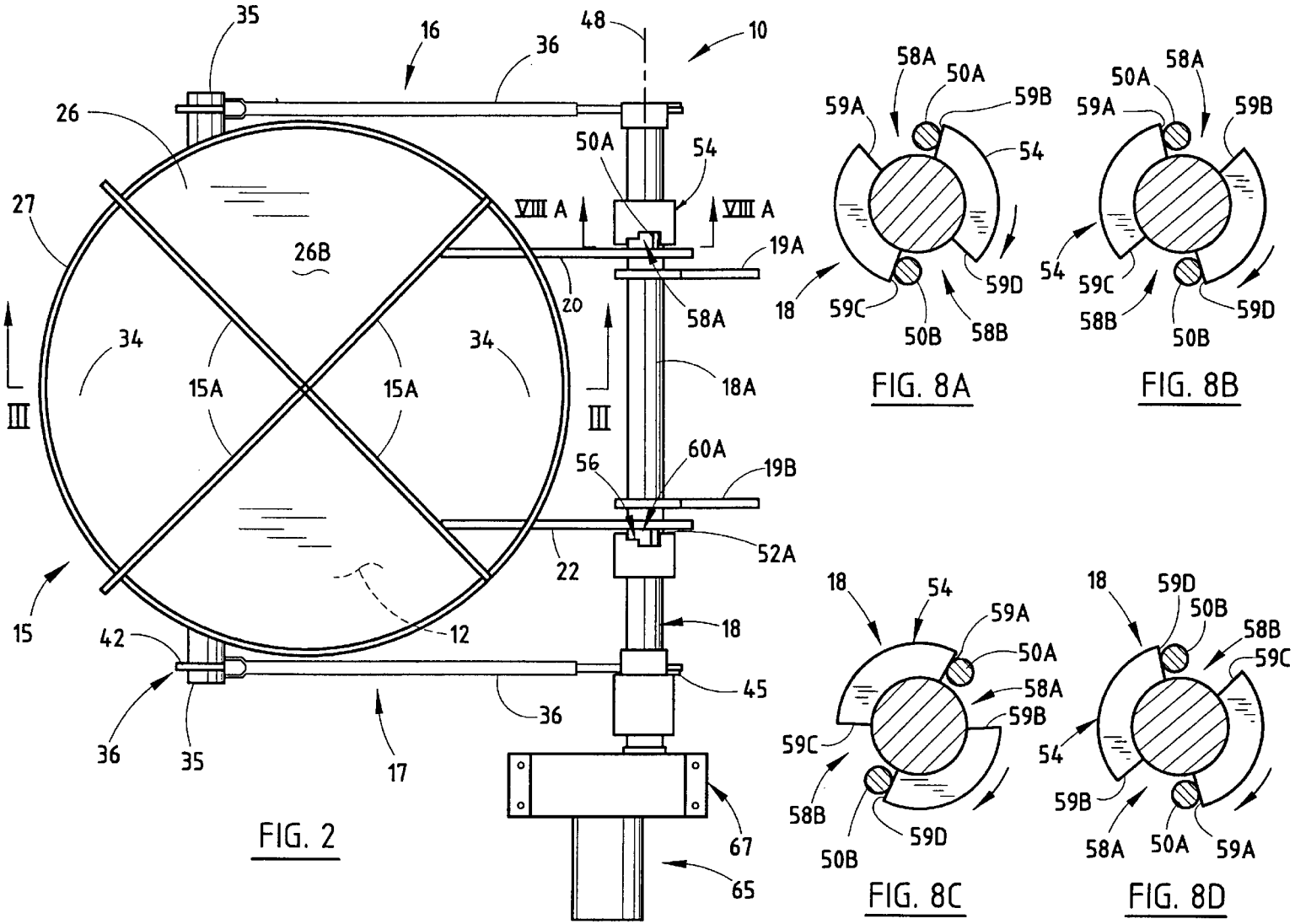
FIG. 2 is a plan view of the hatch opening device of FIG. 1.
FIG. 8A is a cross-sectional view taken along line XIIIA—XIIIA of FIG. 2 when the cover of the hatch opening device is in the closed and locked position shown in FIG. 4.
FIG. 8B is a cross-sectional view similar to FIG. 8A illustrating the hatch device in the closed and unlocked position shown in FIG. 5.
FIG. 8C is a cross-sectional view similar to FIG. 8A illustrating the hatch opening device in the partially open position shown in FIG. 5.
FIG. 8D is a cross-sectional view similar to FIG. 8A illustrating the hatch opening device in the fully open position shown in FIG. 7.

As best seen in FIG. 2, hatch opening device 10 includes a cover 15, which is preferably reinforced by a plurality of ribs 15*a,* and a pair of locking or hold down devices 16 and 17. Cover 15 extends over opening 12 of vehicle 14 and is secured and locked in a closed position by hold down devices 16 and 17, as will be more fully described below. Cover 15 is pivotally mounted on vehicle 14 on a shaft 18 by a pair of bracket arms 20 and 22. Bracket arms 20 and 22 are adapted to engage and disengage from shaft 18 to permit cover 15 to be first unlocked and then subsequently rotated from a closed position to an open position as best illustrated in FIGS. 4–7, as will be more fully described below.

Cover 15 may comprise a metal cover or a molded part, such as cast urethane, and is sized to extend over opening 12. Cover 15 includes an imperforate base member 26 and a first downwardly depending, continuous, annular flange 27 which circumscribes upwardly extending lip or perimeter wall 12*a* of opening 12. Cover 15 further includes a second downwardly extending, continuous, annular flange 28 which is spaced radially inward of flange 27 and extends into opening 12 and is substantially parallel with perimeter wall 12*a* of opening 12. In this manner, when cover 15 is pivoted to the closed position (FIG. 4), flanges 27 and 28 straddle upwardly extending perimeter wall 12*a* of opening 12.

To seal opening 12, cover 15 preferably includes a flexible seal, preferably in the form of an inflatable bladder 32, which is positioned between flange 28 and perimeter wall 12*a*. When cover 15 is closed, bladder 32 is inflated and seals the space between flange 28 and perimeter wall 12*a* to thereby seal opening 12. Preferably, bladder 32 is inflated to a sufficient pressure so that cover 15 remains sealed when vehicle 14 is off-loaded. When vehicles are off-loaded, the container is pressurized in order to assure that the contents in the container is completely discharged. Bladder 32, therefore, eliminates the need for conventional hold down bolts, which are labor intensive and time consuming to lock and unlock.

In the illustrated embodiment, bladder 32 comprises an inflatable tube which is inflated by an external supply of air or an incompressible fluid. The air is delivered to bladder 32 via at least one supply or delivery tube or conduit 32*a* or, optionally, by pair of supply or deliver tubes 32*a*. Supply tube 32*a* extends through an opening 26*a* provided in base member 26 to bladder 32 between flange 28 and peripheral wall 12*a*. More preferably, supply tube 32*a* extends to bladder 32 through an access opening or slot 28*a* provided in flange 28 as shown in the illustrated embodiment in FIG. 3. Supply tube 32*a* is connected to the external supply of air by a coupler 34 which may be mounted to base member 26 of cover 15. Preferably, opening 26*a* of base member 26 is sealed either by coupler 34 or by a conventional seal such as a grommet, as will be understood by those having ordinary skill in the art. As described above, supply tube 32*a* is in communication with the external supply of air, which is preferably an on-board air supply. It can be understood that bladder 32 may be inflated using other fluids including hydraulic fluids. However, in its preferred embodiment, bladder 32 comprises a pneumatic bladder which will avoid the risk of contamination in the event that the bladder or supply tube leaks.

Referring to FIGS. 2 and 4–7, cover 15 further includes a pair of projecting arms or members 35 which extend radially outward from annular flange 27 and provide a gripping or bearing surface for hold down devices 16 and 17 as will be more fully described below. In the illustrated embodiment, projecting arms 35 comprise conventional angle members, each having one leg generally vertically oriented and the other leg generally horizontally oriented. As seen in FIGS. 4–8, the generally horizontally oriented leg may be generally flush with a top surface 26*b* of base member 26. However, it should be understood that other structural shapes may be used for projecting arms 35 and other arrangements may be constructed.

As best seen in FIGS. 4–7, hold down devices 16 and 17 each include a pivotal locking arm member 36 and a driver arm member or linkage 38. Locking arm members 36 are generally "F" shaped and pivotally mounted on one end to vehicle 14 by a mounting bracket 40 and include a first projecting member 42 at its free end. First projecting member 42 is adapted to engage a respective projecting arm 35 of cover 15 when cover 15 is closed so that hold down devices 16 and 17 can lock and seal cover 15 over the respective opening 12. Preferably, projecting arms 35 are aligned and secured to opposed sides of cover 15 so that hold down devices 16 and 17 may work in unison and couple and decouple from projecting arms 35 generally simultaneously. Each locking arm member 36 further includes a second projecting member 44 which is coupled to driver arm member 38. Driver arm members 38 are pivotally coupled at one end to second projecting member 44, which extends parallel to member 42 but is spaced therebelow, and pivotally coupled at their second end to an outwardly projecting member 45, such as a tab or flange, which is mounted on shaft 18. In this manner, when shaft 18 rotates about its longitudinal axis 48, driver arm members 38 pivot locking arm members 36 about mounting brackets 40 between the locked position (FIG. 4) wherein projecting members 42 engage projecting arms 35 to hold cover 15 over opening 12 and a first unlocked position (FIG. 5) wherein projecting members 42 disengage from projecting arms 35 to permit cover 15 to open.

Figures 4, 5, 6, 7:
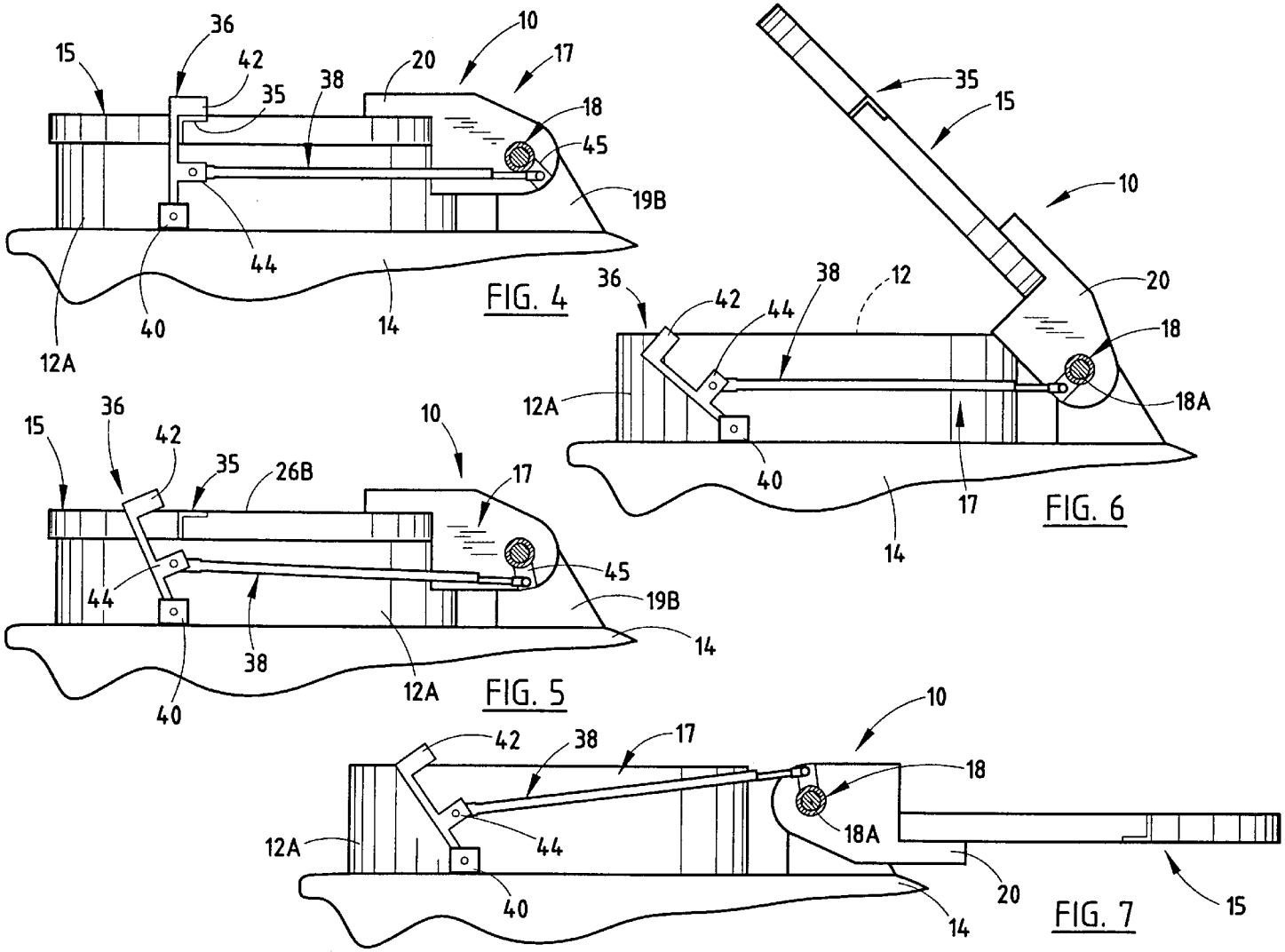
FIG. 4 is a side elevation of the hatch opening device in a closed and locked positioned.
FIG. 5 is a side elevation similar to FIG. 4 of the hatch device in a closed and unlocked position.
FIG. 6 is a side elevation similar to FIG. 4 of the hatch opening device in a partially open position.
FIG. 7 is a side elevation similar to FIG. 4 of the hatch opening device in a fully open position.

In order to permit shaft 18 to pivot hold down devices 16 and 17 from the locked position to the first unlocked position, shown in FIGS. 4 and 5, without pivoting cover 15, shaft 18 is journaled in brackets 20 and 22 of cover 15 to allow free rotation of shaft 18 over discrete ranges of motion thereby providing a "lost motion" device. However, to impart rotation to cover, each bracket 20, 22 includes at least one stop and, more preferably, a pair of stops, such as projecting drive pins 50*a* and 50*b* and 52*a* and 52*b*, respectively, which selectively drivingly couple cover 15 to drive shaft 18. It should be understood that a single stop or more than two stops may be used to achieve substantially similar results. As best seen in FIG. 2, shaft 18 includes a central rod section 18*a* and a pair of spaced collars 54 and 56, which are fixedly mounted to rod section 118*a*. Each collar 54, 56 includes a pair of stops, such as inwardly facing, opposed elongate recesses or notches 58*a*, 58*b* and 60*a* (second notch of collar 56 not shown) which define circumferentially deposed abutments or side walls 59*a*, 59*b*, 59*c*, and 59*d*. Drive pins 50*a* and 50*b* and 52*a* and 52*b* extend into recesses 58*a*, 58*b*, and 60*a* to couple and decouple brackets 20 and 22 and, therefore, cover 15 to and from shaft 18. Hereinafter, reference will be made to collar 54 and pins 50*a* and 50*b* since collar 56 and pins 52*a* and 52*b* include similar configurations to collar 54 and pins 50*a* and 50*b*, respectively, and operate in a like manner to collar 54 and pins 50*a* and 50*b*.

As best seen in FIGS. 4 and 8A, when cover 15 is in the closed position and hold down devices 16 and 17 are in the locked position, drive pins 50*a* and 50*b* are adjacent side walls 59*b* and 59*c* of collar 54, respectively. In the illustrated embodiment, drive pins 50*a* and 50*b* are positioned one hundred and eighty degrees apart and oriented in a generally vertical alignment when cover 15 is in the closed position. However, it can be appreciated that drive pins 50*a* and 50*b* (and drive pins 60*a*) may be arranged in non-vertical alignment and/or may be arranged on shaft rod 18*a* less than one hundred and eighty degrees apart. When rod 18*a* and collars 54 and 56 rotate in a clockwise direction, as viewed in FIG. 8*a*, drive pins 50*a* and 50*b* are drivingly decoupled from shaft 18 and remain essentially stationary, moving between the respective side walls of collar 54. Consequently, cover 15 remains in the closed position. Referring to FIG. 8B, when shaft 18 is rotated such that hold down devices 16 and 17 are pivoted about mounting bracket 40 to the first unlocked position where projecting members 42 are disengaged from projecting arm 35, side walls 59*a* and 59*d* engage drive pins 50*a* and 50*b*. In this manner, cover 15 is drivingly coupled with shaft 18 and hold down devices 16 and 17. Further rotation of shaft 18 induces cover 15 to pivot in unison with shaft 18 about mounting brackets 19*a* and 19*b* to an open position and with hold down devices 16 and 17, which continue to rotate, moving from the first unlocked position to a second unlocked position (FIG. 6). As best seen in FIG. 8D, cover 15 continues to rotate about brackets 19*a* and 19*b* until shaft 18 has completed slightly less than an approximately one-hundred-and-eighty degree revolution from its initial contact point (FIG. 8B) with drive pins 50*a* and 50*b*. In the fully opened position (FIGS. 7 and 8D), cover 15 is preferably pivoted approximately one hundred and eighty degrees from its generally horizontal closed position to a generally horizontal open position to avoid any interference with loading chutes or the like.

In a similar manner, when shaft 18 rotates in a counter clockwise direction as viewed in FIGS. 4–7, shaft 18 closes cover 15 and pivots hold down devices 16 and 17 from their unlocked position to the locked position. It can be appreciated from FIGS. 4–7, when shaft 18 rotates in a counter/clockwise direction, hold down devices 16 and 17 are first pivoted about their respective mounting brackets 40 from the second unlocked position to the first unlocked position. In this position, side walls 59*c* and 59*b* engage pins 50*b* and 50*a*, respectively, to pivot cover 15 from the fully opened position (FIG. 7) to the closed position shown in FIG. 5. As shaft 18 continues to rotate, the shaft decouples from pins 50*a* and 50*b* and, therefore, from cover 15. Furthermore, as shaft 18 continues to rotate, shaft 18 continues to pivot hold down devices 16 and 17 about their respective mounting brackets 40 until projecting members 42 are engaged with projecting arms 35 of cover 15 to thereby lock and seal cover over opening 12.

Preferably, shaft 18, which is part of a driver assembly, is rotated by a driver, such as a motor 65, which is mounted to the vehicle 26 by conventional mounting bracket 67. Motor 65 preferably comprises a twelve or twenty-four volt reversing electric gear motor. It can be understood that motor 65 is preferably powered by the vehicle battery. Furthermore, motor 65 may be actuated by a manually operated switch which is accessible by the operator in the cab of the vehicle.

From the foregoing, it should be understood that automated hatch opening device 10 permits the hatch of a vehicle to be opened and closed without requiring the driver of the vehicle to climb the vehicle or even exit the cab of the vehicle. Consequently, the hatch opening device of the present invention eliminates the risk of injury associated with conventional hatch covers, which require the driver to exit the truck and climb on top of the vehicle to open the hatch manually. The operation of hatch opening device 10 permits a common drive shaft (18) to pivot the hatch cover of a vehicle and pivot a pair of hold down devices through a "lost motion" action, which hold down devices lock and seal the hatch cover over a respective fill opening of a vehicle. Shaft 18 is selectively coupled and uncoupled from the hatch cover by cooperating stops in a manner such that shaft 18 may rotate independently of the cover to operate the hold down devices. In the preferred form, shaft 18 is coupled to cover 15 by a plurality of drive pins 50*a,* 50*b,* 52*a,* 52*b* which engage corresponding abutments provided on shaft 18. Drive pins 50*a,* 50*b,* 52*a,* and 52*b* couple hatch cover 15 to the drive shaft 18 and hold down devices 16 and 17 over a discrete range of motion so that after hold down devices 16 and 17 are pivoted and disengaged from projecting arms 35 of cover 15, cover 15 may be then pivoted and opened by shaft 18.

Figure 9:
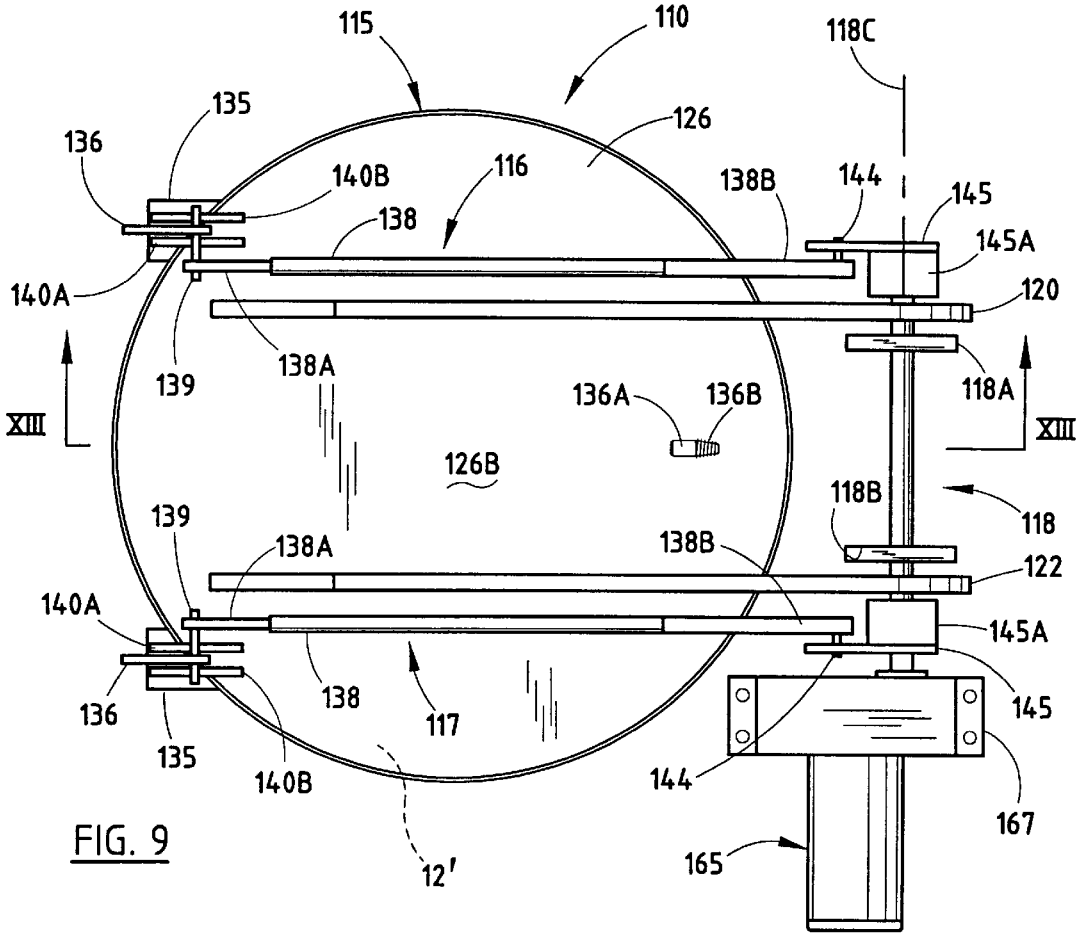
FIG. 9 is a second embodiment of the hatch opening device according to the present invention.
Figure 10:
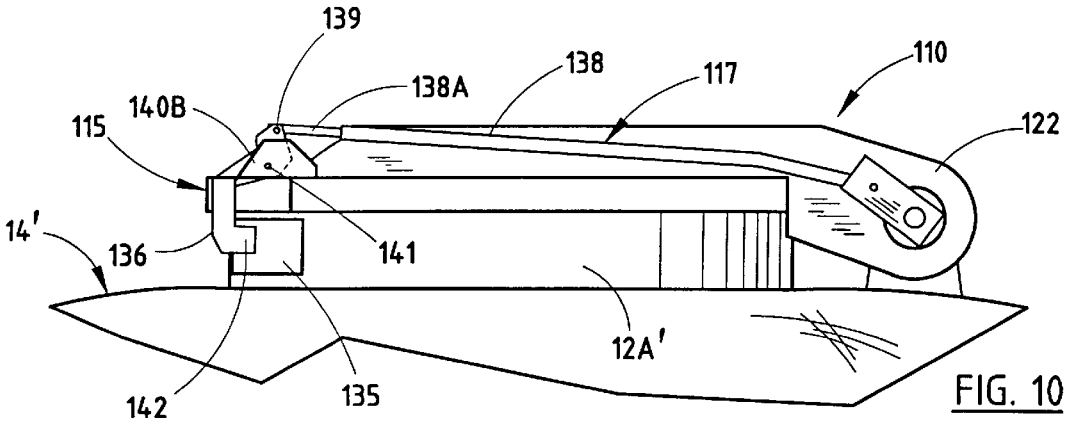
FIG. 10 is a side elevation of the hatch opening device of FIG. 9 illustrating the hatch device in a closed and locked position.
Figure 11:
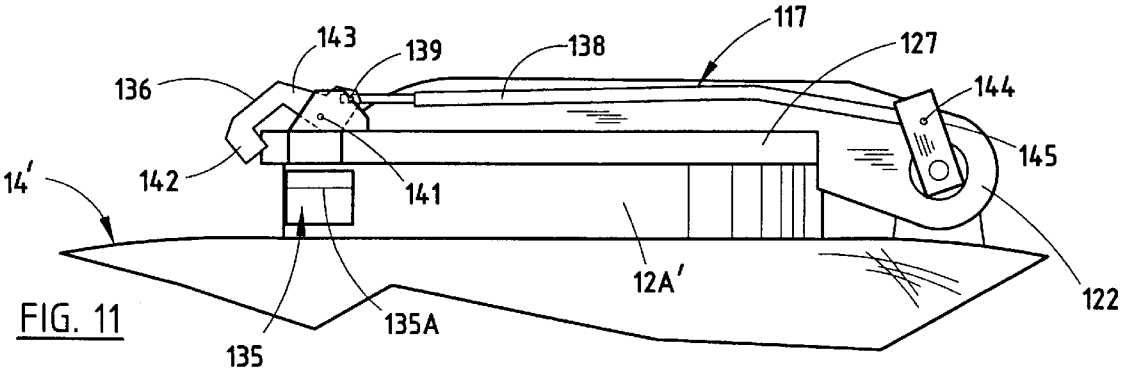
FIG. 11 is a side elevation view of the hatch opening device of FIG. 9 illustrating the hatch opening device in a closed and unlocked position.
Figure 12:
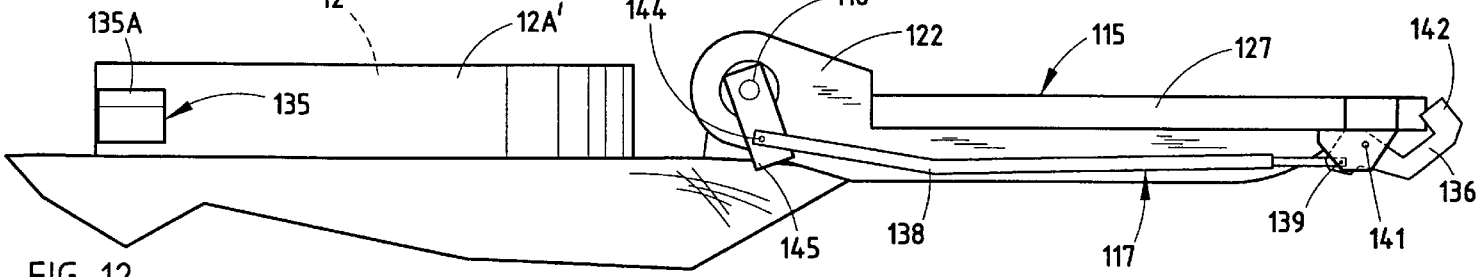
FIG. 12 is a side elevation of the hatch opening device of FIG. 9 illustrating the hatch opening device in an unlocked and fully open position.
Figure 13:
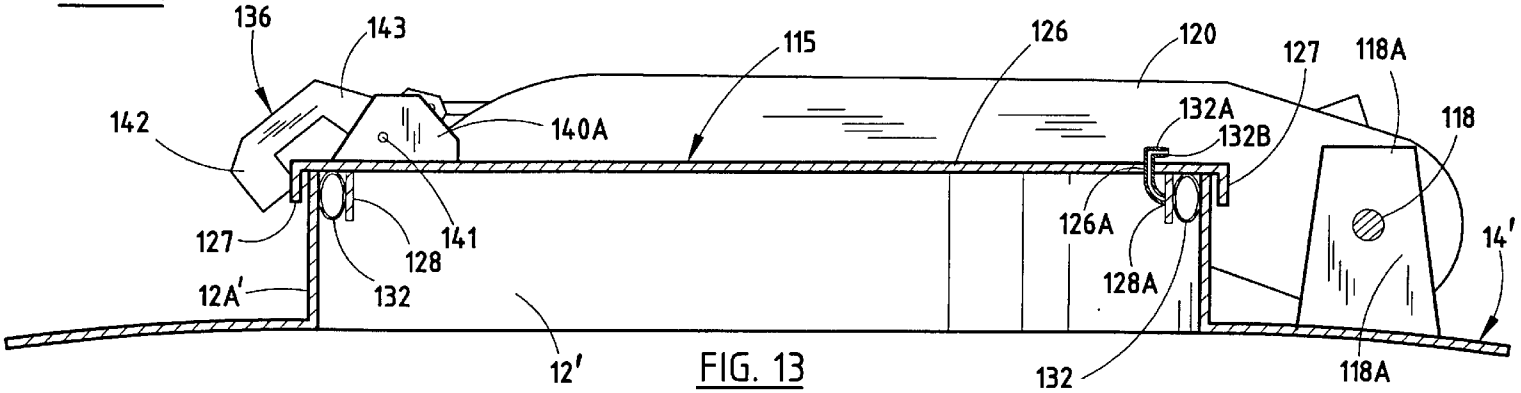
FIG. 13 is a cross-sectional view taking along line XIII—XIII of FIG. 9.

Referring to FIG. 9, a second embodiment 110 of the hatch opening device is illustrated. Hatch opening device 110 includes a cover 115 and a pair of locking or hold down devices 116 and 117. Cover 115 extends over opening 12' of vehicle 14' and is secured and locked in a closed position by hold down devices 116 and 117 as will be more fully described below. Cover 115 is pivotally mounted on vehicle 14' on a shaft 118 by a pair bracket arms 120 and 122, which are journaled on shaft 118. Shaft 118 is mounted to vehicle 14 by a pair of spaced apart mounting brackets 118*a* and 118*b* and is journaled in brackets 118*a* and 118*b* so shaft 118 is free to rotate about its longitudinal axis 118C. Bracket arms 120 and 122 provide stiffness to cover 115 and provide a fulcrum so that cover 115 can be rotated from a closed position to an unlocked position as best illustrated in FIGS. 10–12 by hold down devices 116 and 117.

Cover 115 may comprise a metal cover or a molded part such as cast urethane, and is dimensioned to extend over opening 12' of vehicle 14'. Referring to FIG. 9, cover 115 preferably includes an imperforate base member 126 and a first or outer downwardly depending continuous annular flange 127 which circumscribes outwardly extending lip or perimeter wall 12*a'* of opening 12'. Cover 115 further includes a second or inner downwardly extending continuous annular flange 128 which is spaced radially inward of flange 127 and extends into opening 12'. Annular flange 128 is substantially parallel with perimeter wall 12*a'* of opening 12'. In this manner when cover 115 is pivoted to the closed position (FIGS. 10 and 11), flanges 127 and 128 straddle upwardly extending perimeter wall 12*a'* of opening 12'.

To seal opening 12', cover 115 preferably includes a flexible seal similar to the first embodiment, which preferably comprises an inflatable bladder 132 which is positioned between flange 128 and perimeter wall 12*a'*. When cover 115 is in the closed position, bladder 132 is inflated and seals the space between flange 128 and perimeter wall 12*a'* to thereby seal opening 12'.

In the illustrated embodiment, bladder 132 comprises an inflatable tube which is inflated by an external supply of air or an incompressible fluid. Air is delivered to bladder 132 via at lease one supply or delivery tube a conduit 132*a,* which includes an air inlet nozzle 132*b,* which is positioned on upper surface 126*b* of base member 126. Supply tube 132*a* extends through an opening 126*a* provided in cover 15 and an opening 128*a* provided in an inner annular flange 128 and is connected to an external supply of air through nozzle 132*b*. Preferably opening 126*a* in cover 115 is sealed either by a coupler (not shown) or by a conventional seal such as a grommet.

Annular wall 12*a'* further includes a pair of projecting members 135, which are welded or otherwise secured to annular wall 12*a'* and extend outwardly from annular wall 12*a'* to provide an engagement or bearing surface, such as a leg 135*a*. When moved to their respective locking positions, hold down devices 116 and 117 engage legs 135*a* and thereby lock cover 115 in its closed position. Preferably projecting members 135 are aligned and secured to opposite sides of annular wall 12*a'* so that hold down devices 116 and 117 may work in unison and couple and decouple from projecting members 135 generally simultaneously. In the illustrated embodiment, projecting arms 135 comprise angle members. However, it should be understood that projecting members 135 may comprise other members, including open ended tubular members or the like.

Referring to FIGS. 10–13, hold down devices 116 and 117 each include a driver member or linkage 138 and a pivotal locking member 136 which is pivotally mounted to an end portion 138*a* of driver member or linkage 138 by a pin or shaft 139. Locking members 136 are generally "C" shaped and are pivotably mounted to cover 115 by a pair of spaced apart brackets 140*a* and 140*b* which are mounted to vehicle 14'. Each locking arm member 136 includes a lower projecting member 142 at its free end and an upper transverse member 143, which is pivotally coupled at a lower portion thereof to bracket 140*a* by pin 141 and pivotally coupled at an upper portion thereof by pin 139 to driver arm member or linkage 138. Pins 141 extend transversely through locking members 136 and through spaced apart brackets 140*a* and 140*b* to thereby pivotally mount locking members 136 to brackets 140*a* and 140*b* and cover 115. As best seen in FIG. 9, opposed end portions 138*b* of driver arms 138 are pivotably coupled by pins 144 to projecting members 145, which are fixedly mounted to shaft 118. As shaft 118 rotates about its longitudinal axis 118*c,* projecting members 145 rotate with shaft 118 and pull on driver arms 138. Since pins 141 are spaced from pins 139, when driver arms 138 pull on locking members 136, locking members 136 pivot about pins 141 from a locked position, shown in FIG. 10, wherein lower projecting members 142 are engaged with projecting members 135, to an unlocked position, shown in FIG. 11, wherein lower projecting members 142 are disengaged from projecting members 135.

Again, referring to FIG. 9, projecting members 145 may be secured to shaft 118 by mounting collars 145*a*. In this manner, when shaft 118 rotates about its longitudinal axis 118*c* driver arms 138 pivot locking arm members 136 about pins 141 to disengage locking arm members 142 from projecting members 135, and further rotation of shaft 118 induces rotation of cover 115 about shaft 118 to move cover 115 from a closed unlocked position to the open, unlocked position as shown in FIGS. 11 and 12.

Similar to the first embodiment, shaft 118 is driven about its axis of rotation 118*c* by a motor 165, which is mounted to vehicle 14' by a mounting bracket 167. Motor 165 preferably comprises a 12 or 24 volt reversing electric gear motor, and is preferably powered by the vehicle battery (not shown).

It should be understood from the foregoing that the closure of cover 115 follows a similar reverse sequence described in reference to the opening of cover 115, with the sequence starting with motor 165 driving shaft 118 to rotate in a counter clockwise direction, as viewed in FIG. 10. Shaft 118 rotates projecting members 145 so that locking arms 138 rotate cover 115 to its closed position. After cover 115 is pivoted to its closed position, driver arms 138 pivot locking arm members 136 about pins 141 to move lower projecting members 142 from their unlocked positions to their locked positions shown in FIG. 10 to engage projecting members 135 and thereby lock cover 115 in its closed position.

While several forms of the invention have been shown and described, other forms will now be apparent to those skilled in the art. Therefore, it will be understood that the embodiment shown in the drawings and described above is merely for illustrative purposes, and is not intended to limit the scope of the invention which is defined by the claims which follow and are interpreted under the Doctrine of Equivalents.

We claim:

1. A hatch opening and closing device for a vehicle comprising:

a cover adapted to cover and seal an opening in the vehicle and to pivot between an open position and a closed position;

at least one locking device adapted to move between an unlocked position and a locked position, said locking device being adapted to move from said unlocked position to said locked position when said cover is in said closed position and to lock said cover in said closed position and being adapted to move from said locked position to said unlocked position to unlock said cover to permit said cover to move from said closed position to said open position, and said cover being drivingly coupled to said locking device over a first range of motion of said locking device for movement therewith and decoupled from said locking device over a second range of motion of said locking device; and a driver assembly moving said locking device between said unlocked position and said locked position and pivoting said cover between said open position and said closed position, said driver assembly releasably coupling said cover to said locking device over said first range of motion, said driver assembly including a shaft, said shaft being coupled to said locking device and releasably coupled to said cover, said shaft pivoting said cover between said open position and said closed position when said shaft is coupled to said cover and rotating freely from said cover when said cover is decoupled from said shaft, and said shaft moving said locking device between said unlocked position and said locked position, wherein one of said shaft and said cover includes a stop and the other of said shaft and said cover includes a pair circumferentially disposed abutments, and said stop moving between said abutments when said cover is uncoupled from said shaft and engaging one of said abutments to couple said cover to said shaft.

2. A hatch opening and closing device according to claim 1, wherein said abutments are defined by an elongate recess.

3. A hatch opening and closing device according to claim 1, wherein said stop comprises a pin.

4. A hatch opening and closing device according to claim 1, wherein said shaft includes said circumferentially spaced abutments, and said cover includes said stop.

5. A hatch opening and closing device according to claim 4, wherein said shaft includes at least one collar secured thereto, said collar including an elongate recess, said circumferentially spaced abutments being defined by said elongate recess, and said stop extending into said elongate recess and engaging one of said abutments when said shaft is rotated between an uncoupled position, wherein said shaft is uncoupled from said cover, and a coupled position, wherein said shaft is coupled to said shaft.

6. A hatch opening and closing device according to claim 1, wherein said locking member is pivotally mounted to said cover and is adapted to engage the vehicle when said cover is in said closed position to lock said cover in said closed position.

7. A hatch opening and closing device according to claim 6, wherein said locking device includes a linkage arm, said linkage arm being coupled to said locking member and being adapted to pivot said locking member.

8. A hatch opening and closing device according to claim 7, further comprising a driver assembly, said driver assembly including a shaft, said shaft extending through said cover and being coupled to said linkage arm, said shaft rotating about a longitudinal axis and moving said linkage arm such that said locking member pivots between said engaging position and said disengaging position, and said linkage arm being adapted to pivot said cover from said closed position to said open position after said locking member is pivoted to said disengaging position.

9. A hatch opening and closing device for a vehicle comprising:

a cover adapted to cover and seal an opening in the vehicle and to pivot between an open position and a closed position; and at least one locking device adapted to move between an unlocked position and a locked position, said locking device being adapted to move from said unlocked position to said locked position when said cover is in said closed position and to lock said cover in said closed position and being adapted to move from said locked position to said unlocked position to unlock said cover to permit said cover to move from said closed position to said open position, and said cover being drivingly coupled to said locking device over a first range of motion of said locking device for movement therewith and decoupled from said locking device over a second range of motion of said locking device, said locking device including a locking member, said locking member being adapted to pivot from an engaging position, wherein said locking member locks said cover in said closed position, to a non-engaging position, wherein said locking member releases and allows said cover to move from said closed position to said open position when said locking member moves from said locked position to said unlocked position, and said locking member engaging said cover when said locking member is in said engaging position to lock said cover in said closed position and disengages from said cover when said locking device is pivoted to said disengaging position.

10. A hatch opening and closing device for a vehicle comprising:

a cover;

a rotatable shaft journaled in said cover, said shaft adapted to couple to and decouple from said cover whereby said shaft pivots said cover between an open position and a closed position when said cover is coupled to said shaft;

at least one locking device coupled to said shaft, said locking device including a locking member, said locking member being pivoted by said shaft between a locked position and an unlocked position; and a driver coupled to said shaft, said driver rotating said shaft about a longitudinal axis whereby said shaft pivots said locking member from said locked position to said unlocked position and thereafter pivots said cover from said closed position to said open position when opening said cover and pivots said cover from said open position to said closed position and thereafter pivots said locking member from said unlocked position to said locked position.

11. A hatch opening and closing device according to claim 10, wherein said cover includes a bracket, said shaft being rotatably journaled in said bracket.

12. A hatch opening device according to claim 11, wherein one of said bracket and said shaft includes at least one stop and the other of said bracket and said shaft includes at least two spaced apart abutments, said stop engaging one of said abutments to couple said bracket to said shaft and moving between said abutments to decouple said bracket from said shaft.

13. A hatch opening and closing device according to claim 12, wherein said spaced apart abutments are defined by a recess.

14. A hatch opening and closing device according to claim 10, wherein locking member is adapted to be pivotally mounted to the vehicle, said shaft being drivingly coupled to said locking member by a linkage member.

15. A hatch opening and closing device according to claim 14, wherein said linkage member is pivotally mounted to said locking member on a first end and pivotally mounted to said shaft on a second end.

16. A hatch opening and closing device according to claim 10, wherein said locking member includes a projecting member, said projecting member being adapted to engage one of the cover and the vehicle to lock said cover in said closed position.

17. A hatch opening and closing device according to claim 16, wherein said cover includes a projecting arm, said projecting member of said locking member engaging said projecting arm to lock said cover in said closed position.

18. A hatch opening and closing device according to claim 10, including a second locking device having a second locking member and being spaced from said first locking device, said first and second locking devices each being coupled to said shaft, said shaft pivoting each of said locking members and moving each of said locking members from said locked position to said unlocked position.

19. A hatch opening and closing device comprising:

a shaft adapted to be rotatably mounted on a vehicle, said shaft including at least one collar mounted thereon, and said collar including a recess defining first and second abutments;

a driver drivingly coupled to said shaft to rotate said shaft about a longitudinal axis of said shaft;

a cover having a bracket, said shaft journaled in said bracket, said bracket including a coupling member, said coupling member engaging one of said abutments to couple said cover to said shaft and being disengaged from said shaft to decouple said cover from said shaft; and at least one locking arm adapted to be pivotally mounted to the vehicle, said locking arm being drivingly coupled to said shaft and moving between a locked position wherein said locking arm is engaged with said cover and an unlocked position wherein said locking arm is disengaged from said cover.

20. A hatch opening and closing device according to claim 19, wherein said driver comprises a motor.

21. A hatch opening and closing device according to claim 20, wherein said motor comprises a reversing motor, said reversing motor rotating said shaft over a range of motion of about one hundred and eighty degrees.

22. A hatch opening and closing device according to claim 19, wherein said abutments are recessed in said collar.

23. A hatch opening and closing device according to claim 19, further comprising a second locking arm, said second locking arm being adapted to be pivotally mounted to the vehicle and being drivingly coupled to said shaft, said locking arms moving between said locked position when said driver rotates said shaft about said longitudinal axis wherein each of said locking arms is engaged with said cover and an unlocked position wherein said locking arms are disengaged from said cover.

24. A hatch opening and closing device according to claim 19, said cover including a projecting arm, said locking arm engaging said projecting arm when said locking arm is in said locked position.

25. A hatch opening and closing device according to claim 19, wherein said locking arm is coupled to said drive shaft by a linkage member, said linkage member having one end pivotally coupled to said locking arm and a second end pivotally coupled to said shaft.

26. A hatch opening and closing device according to claim 19, wherein said bracket includes at least one stop, said stop selectively engaging said collar, said shaft opening said cover when said stop is engaged with said collar and drivingly decoupled from said cover when said stop is disengaged from said collar.

27. A hatch opening and closing device according to claim 19, wherein said cover includes a pair of spaced downwardly projecting flanges, one of said flanges for extending into the opening of the vehicle.

28. A hatch opening and closing device according to claim 27, wherein said cover further includes a flexible seal for positioning between an inner flange of said pair of flanges and the opening of the vehicle to seal the opening.

29. A hatch opening and closing device according to claim 28, wherein said flexible seal comprises an inflatable bladder.

* * * * *

UNITED STATES PATENT AND TRADEMARK OFFICE

CERTIFICATE OF CORRECTION

PATENT NO. : 5,937,581
DATED : August 17, 1999
INVENTOR(S) : Reinhard Matye and Phillip Dean Skeel It is certified that error appears in the above-identified patent and that said Letters Patent is hereby corrected as shown below:

Column 5,
Line 56, please delete "118a" and insert in lieu thereof -- 18a --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*